US005951418A

United States Patent [19]

Atkinson

[11] Patent Number: 5,951,418

[45] Date of Patent: Sep. 14, 1999

[54] POLO MALLET AND METHOD OF REPAIR

[76] Inventor: William G. Atkinson, 81420 Ave. 52, Indio, Calif. 92201

[21] Appl. No.: 09/017,854

[22] Filed: Feb. 3, 1998

[51] Int. Cl.[6] ..... A63B 59/16

[52] U.S. Cl. ..... 473/558; 81/19

[58] Field of Search ..... 473/412, 558, 473/FOR 126, FOR 191; 81/17, 489

[56] References Cited

U.S. PATENT DOCUMENTS

| | | | |
|---|---|---|---|
| 434,772 | 8/1890 | Eaton | 81/19 |
| 2,140,383 | 12/1938 | Howard | 473/558 |
| 2,304,585 | 12/1942 | McMinn | 473/558 |
| 3,472,512 | 10/1969 | Berry | 473/412 |
| 4,192,505 | 3/1980 | Tabickman et al. . | |
| 4,361,325 | 11/1982 | Jansen . | |
| 4,643,784 | 2/1987 | Germond . | |
| 4,866,901 | 9/1989 | Sanchez . | |
| 4,905,441 | 3/1990 | Landers . | |
| 5,308,064 | 5/1994 | Jen | 473/412 |
| 5,573,354 | 11/1996 | Koch . | |
| 5,607,154 | 3/1997 | Meumann et al. . | |
| 5,628,509 | 5/1997 | Christian . | |

FOREIGN PATENT DOCUMENTS

| | | |
|---|---|---|
| 7761 | 4/1894 | United Kingdom . |
| 16597 | 5/1908 | United Kingdom . |

*Primary Examiner*—Mark S. Graham
*Attorney, Agent, or Firm*—Chase & Yakimo, L.C.

[57] ABSTRACT

An improved polo mallet includes a single-cane upper shaft portion spliced to a twin-cane lower shaft portion which is securely joined to a mallet head. The upper shaft portion maintains the flexibility required for effective game play while the lower shaft portion provides increased strength and durability at the point of frequent breakage for increasing the useful life of the polo mallet. The lower shaft portion is secured within a non-circular aperture in the mallet head to thereby prevent shaft twisting or rotation which may cause unnecessary premature breakage. This invention further includes a cost-effective method of repairing broken polo mallets whereby a broken shaft is removed and replaced with a twin-cane shaft which is then spliced to the remaining original shaft and is insertably secured within corresponding apertures in the mallet head.

15 Claims, 6 Drawing Sheets

POLO MALLET AND METHOD OF REPAIR

BACKGROUND OF THE INVENTION

This invention relates generally to an improved polo mallet construction and, more particularly, to a twin-cane polo mallet shaft which increases the durability and useful life of the polo mallet. This invention further relates to a cost-effective method of repairing broken polo mallets.

The game of polo involves two teams of four players mounted on horses. Each player uses a long mallet to strike a 3½ inch hard plastic ball in an effort to score goals against the opposing team. It is well known that a polo player will break many mallets during the course of a match either by striking the ball, inadvertently striking the ground, or by striking another player's mallet. Polo players incur considerable expenditures to supply, replace, or repair broken mallets.

Several factors contribute to the problem of frequent mallet breakage. A polo mallet may be initially weakened by its method of construction. Generally, a rattan cane is inserted into a round hole in a mallet head and then expanded by driving a wedge into the cane from the underside of the mallet head. As the cane is split by the wedge, a fissure or crack may extend upward into the rattan shaft, thereby weakening the shaft. Further, placement of a circular rattan cane into a corresponding circular hole allows the cane to rotate and loosen during game play, contributing to breakage. Finally, a rattan mallet is further weakened by the force of each impact with the hard plastic ball, ground, or opponent's mallet. Thus, it is desirable to have a polo mallet which is not initially weakened by a wedge construction, and is resistant to twisting, loosening, or shattering during game use. It is also desirable to have a cost-effective method for repairing a broken polo mallet so as to strengthen the mallet and thus enhance its useful life.

SUMMARY OF THE INVENTION

In response thereto, I have invented a polo mallet and method for repairing a broken polo mallet which cost-effectively increases the durability and useful life of polo mallets. The polo mallet utilizes a shaft comprising an upper single-cane shaft portion and a lower shaft portion having a pair of conjoined rattan canes. The single-cane upper shaft portion maintains the flexibility required for generating maximum torque when striking a polo ball while the twin-cane lower shaft portion increases the overall strength of the mallet at the typical point of breakage. The lower portion of a shaft is insertably joined with a mallet head having adjacent overlapping bores correspondingly positioned to receive the twin rattan canes comprising said shaft. The shaft is secured to the mallet head without penetrating the shaft with a wedge. The twin-cane lower shaft portion and corresponding mallet head bores are configured such that rotation or twisting of the shaft is prevented. In the case of repairing a broken mallet, the broken segment is removed and replaced with a twin-cane shaft from the point of breakage to the mallet head. The twin-cane segment is then spliced to the remaining undamaged shaft.

It is therefore a general object of this invention to provide an improved polo mallet and method of repair having a twin-cane lower shaft portion which is more durable and resistant to shattering during game play.

Another object of this invention is to provide an improved polo mallet and method of repair, as aforesaid, having a twin-cane lower shaft portion which is attached to a mallet head in a manner which prevents the shaft from rotating or twisting during game play.

Still another object of this invention is to provide an improved polo mallet and method of repair, as aforesaid, which secures the shaft to the mallet head without penetrating the shaft with a wedge.

A further object of this invention is to provide an improved polo mallet and method of repair, as aforesaid, which cost-effectively increases the useful life of new or repaired polo mallets.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
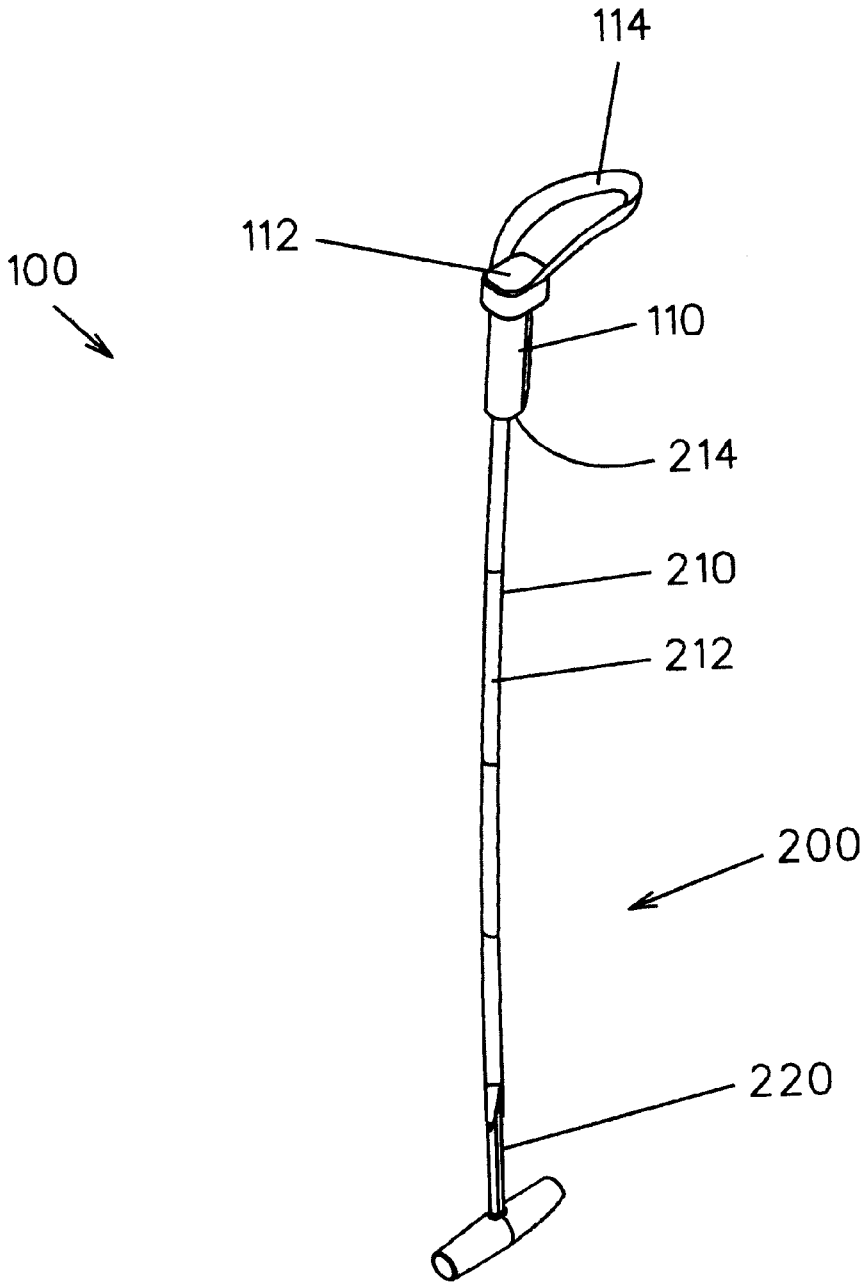
FIG. 1 is an isometric view of the improved mallet.

Turning more particularly to the drawings, FIG. 1 shows the improved polo mallet 100 having an elongated cylindrical vertical shaft 200, said shaft 200 comprising upper 210 and lower 220 shaft portions. The upper shaft portion 210 comprises a single relatively flexible cylindrical rod 212, preferably a rattan cane, having a first end 214 fixedly attached to a handle 110. Handle 110 includes a wrist strap/sheath 114 fixedly attached to a top side 112 thereof for receiving a player's hand therethrough and enhancing the player's grip on said handle 110. As better shown in FIG. 5, the upper shaft portion 210 further includes a second end 216 having an inverted V-shaped notch 218 for splicedly receiving an inverted V-shaped first end 222 of the lower shaft portion 220, (see FIGS. 5 and 6) the method of attachment being further described later.

Figure 2:
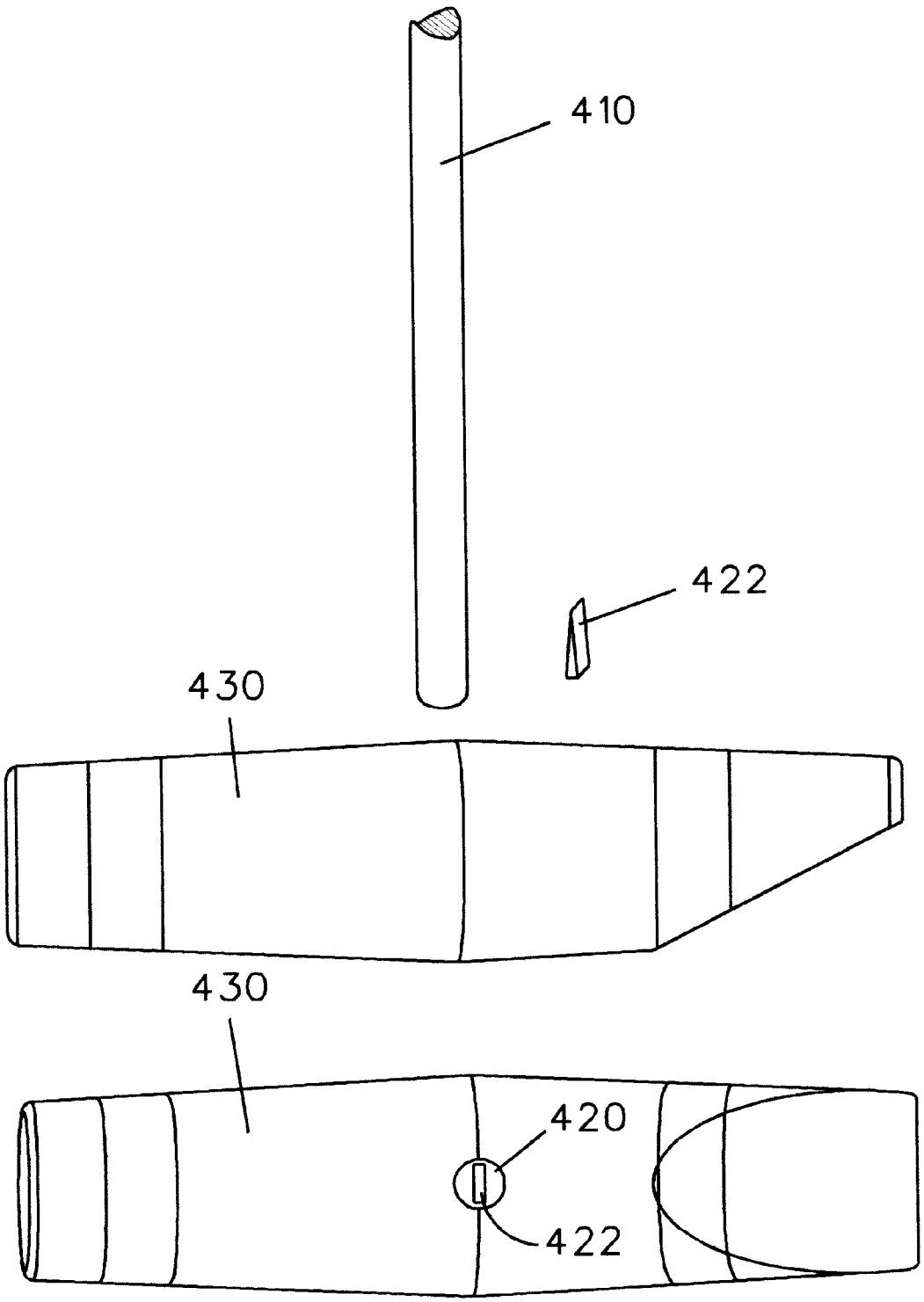
FIG. 2 is a perspective exploded view of an unimproved mallet showing a wedge on the underside of the mallet head used to secure the shaft to the mallet head.
Figure 3:
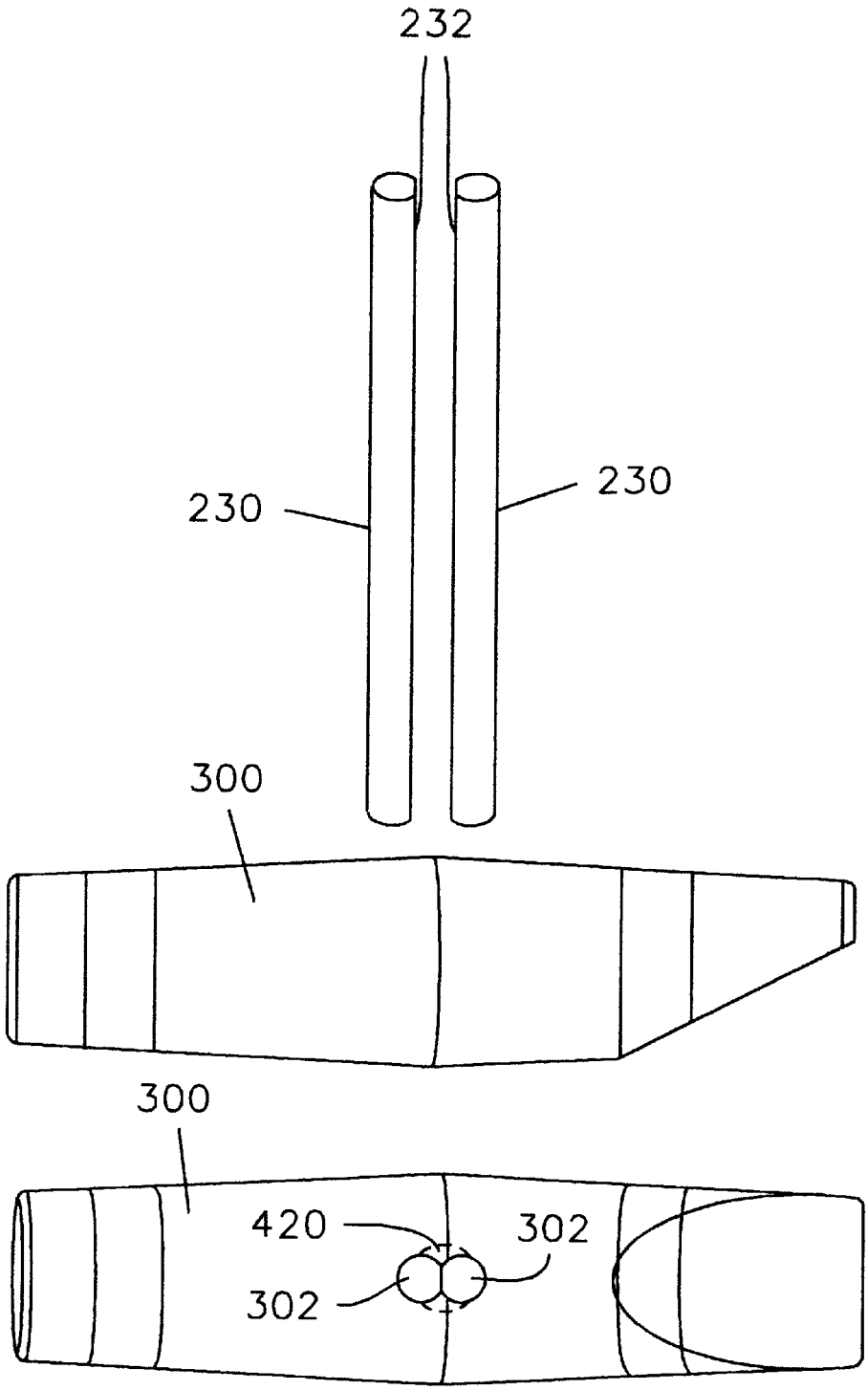
FIG. 3 is a perspective view of the improved mallet showing the overlapping apertures of the bores on the underside of the mallet head for receiving the lower shaft portion.
Figure 5:
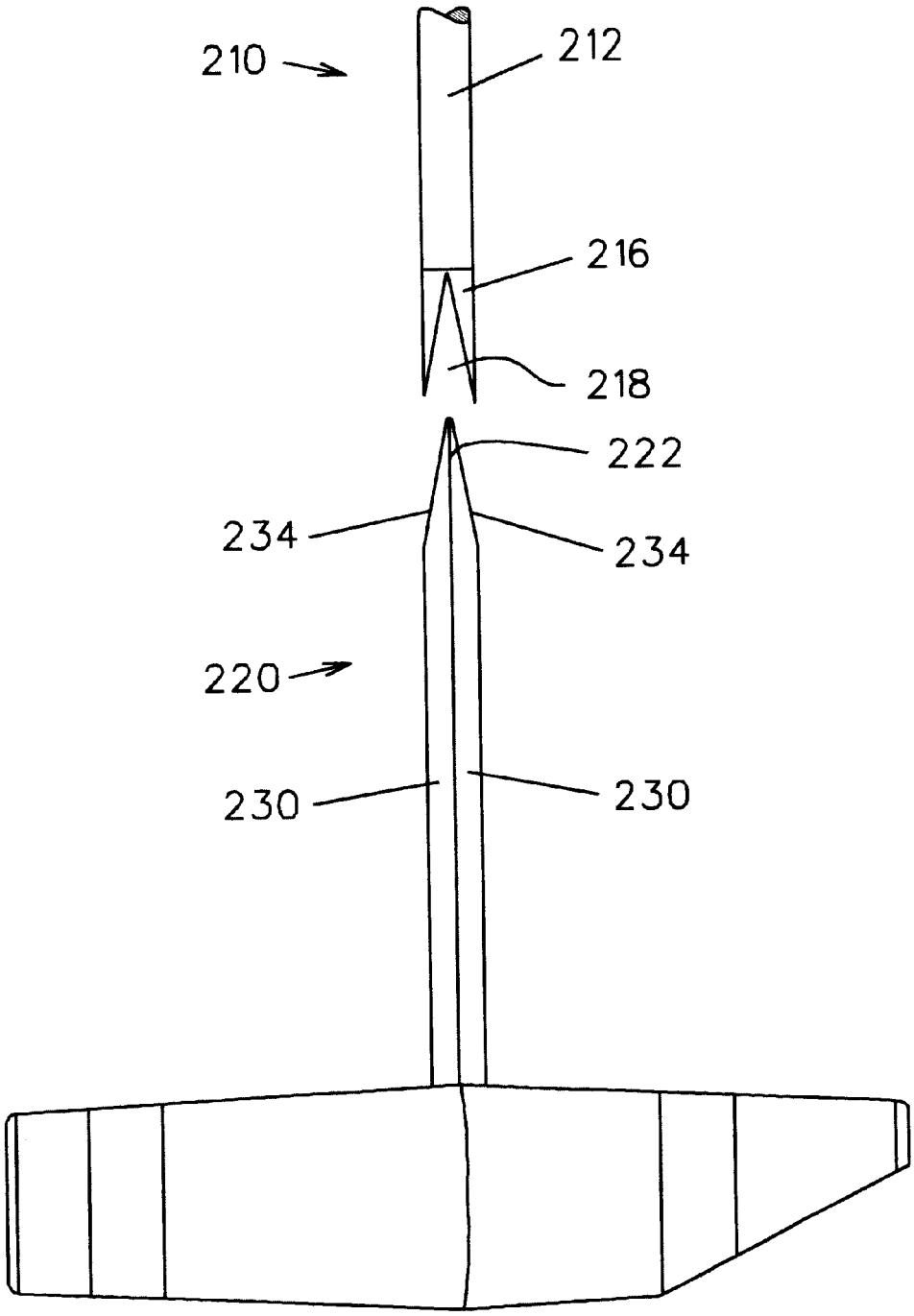
FIG. 5 is a perspective view of the mallet assembly showing a replacement lower shaft portion being spliced to an existing shaft.
Figure 6:
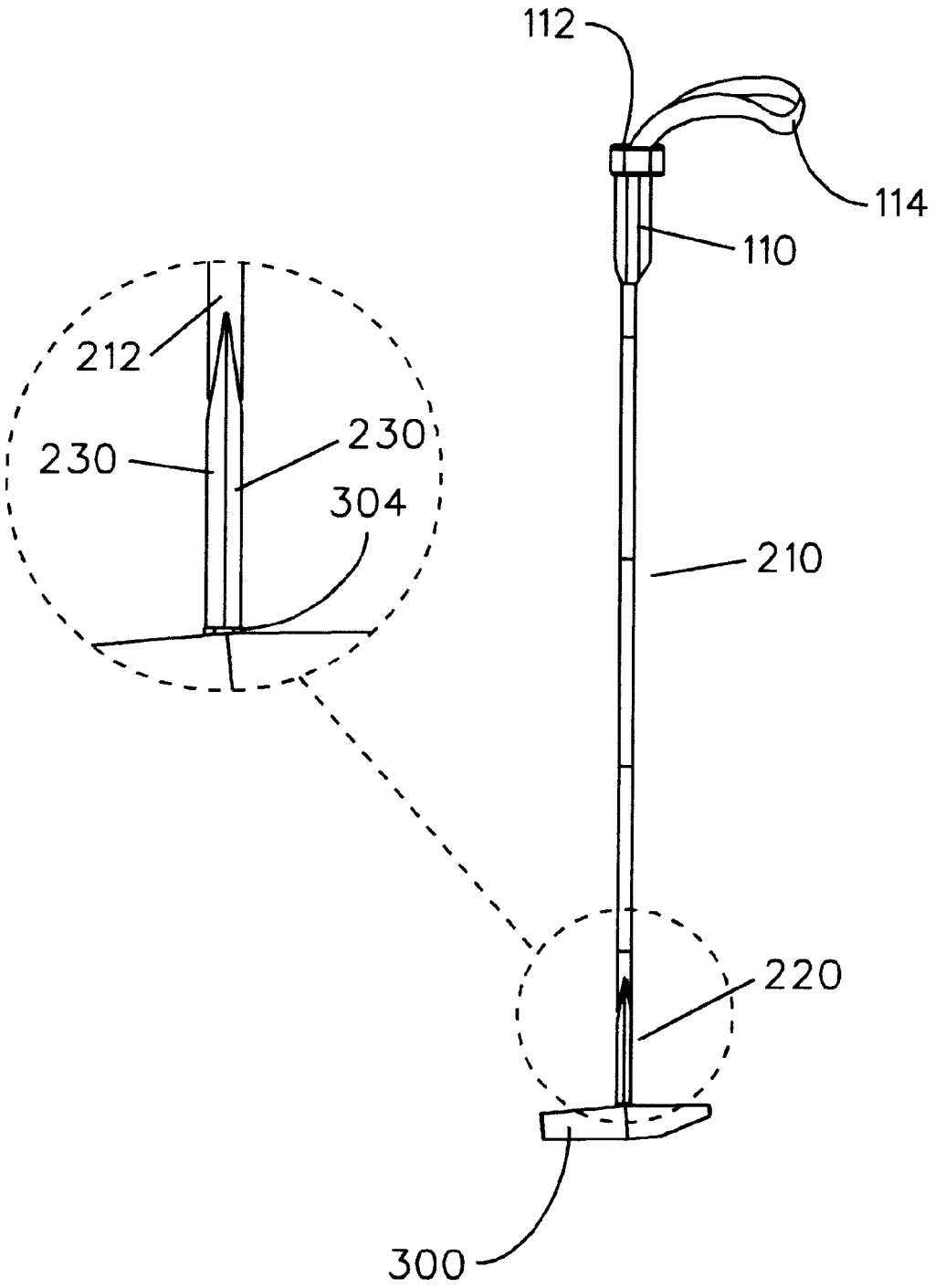
FIG. 6 is a perspective view of a broken mallet following repair with a replacement lower shaft portion.

Turning to FIGS. 3, 5, and 6, the lower shaft portion 220 includes two generally cylindrical rods 230, preferably rattan canes, each rod 230 having a diameter approximately one-half the size of the upper shaft portion 210 and relatively more rigid than rod 212. Each rod 230 presents an interiorly planar side 232, preferably formed by sanding a completely cylindrical rod 230, said planar sides 232 being adhesively joined together to form a relatively rigid shaft. This structure better resists breakage than a shaft made entirely of a single rod or cane 410 (see FIG. 2). It is understood that the adhesive used to join elements of this invention may be Epoxy glue or other wood bonding resins. The upper free ends of the rods 230 of the lower shaft portion 220 present inwardly exterior side walls 234, said exterior side walls 234 cooperating to form an inverted V-shaped first end 222. This first free end 222 is adhesively attached to a corresponding inverted V-shaped notch 218 in the second lower free end 216 of the upper shaft portion 210. It is understood that while a V-shaped splice method is preferred, other configurations may alternatively be employed.

A new polo mallet 100 as disclosed herein includes adjacent overlapping generally circular bores 302 vertically extending through a mallet head 300 (FIG. 3) which presents a central bore for receiving the rods 230 of the lower shaft portion 220. The exterior surface of the joined rods 230 is contiguous to the interior surface of the central bore upon insertion of rods 230 therein. Rods 230 are adhesively secured within the corresponding bores 302 in the mallet head 300. A narrow band 304 of adhesive extends about the juncture of the apertures of bores 302 and lower shaft portion 220. It is understood that the generally circular overlapping bores 302 in the mallet head 300 cooperate with the configuration of the rods 230 of the lower shaft portion 220 to lock the shaft 200 into the mallet head 300. The planar sides 232 centrally bisect the central bore or extend along an imaginary chord extending between the two points of intersection of the overlapping bores 302. The non-circular configurations of the central bore and rod exterior surface as well as the extension of the planar sides 232 across the central bore precludes rotation of the lower shaft portion 220 within the bores 302. The entire shaft 200 is therefore prevented from twisting or rotating during game play, unlike the movement permitted by a single circular rod 410 mounted in a circular aperture 420 in other polo mallet head 430 designs (see FIG. 2).

Figure 4:
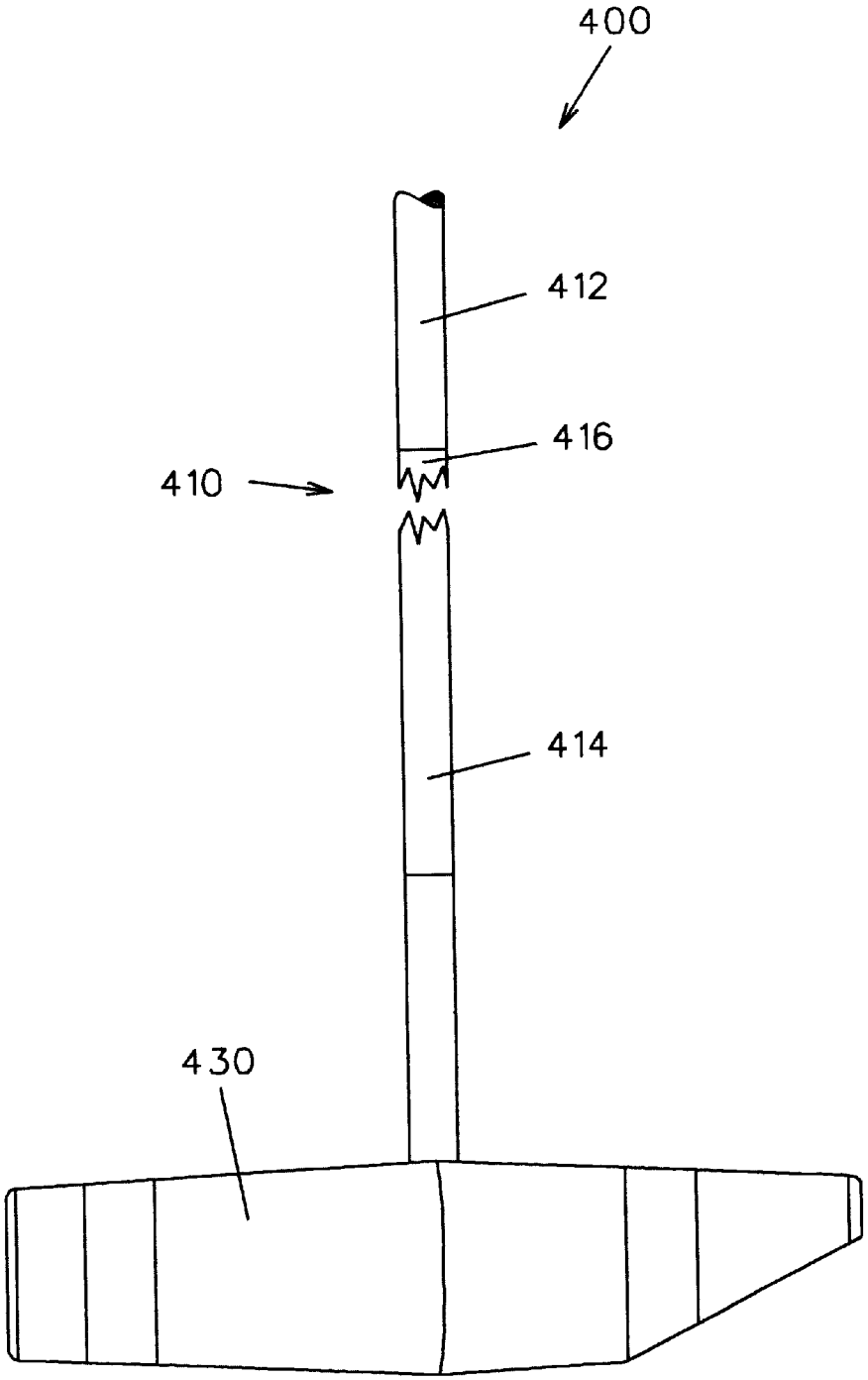
FIG. 4 is a perspective view of a broken mallet prior to repair.

FIG. 4 shows a mallet 400 of typical single shaft design having a broken shaft 410. To repair the broken mallet, the broken end 416 of the upper portion 412 of the broken shaft 410 must be cleanly severed to facilitate cutting the end 416 to form an inverted V-shaped notch 218 as previously described. Next, the lower portion 414 of the broken shaft 410 is removed from the mallet head 430, including the wedge 422 if originally so constructed (see FIG. 2). A wooden or rattan core is insertably adhesively joined to the resulting bore 420. FIG. 3 illustrates that the generally circular overlapping bores 302 are then bored through the core in the mallet head in approximately the same position as the previous single bore 420. A replacement lower shaft portion 220 is inserted into the overlapping bores 302 and splicedly attached to the upper shaft portion 210 as described earlier.

Accordingly, it can be seen that the polo mallet disclosed herein maintains the flexibility required for effective game play while enhancing the strength of the polo mallet at the typical point of breakage. A lower shaft portion having two rods or canes is spliced together with an upper single-rod upper shaft portion and secured within a non-circular aperture in the mallet head. As the two rod lower shaft portions are more rigid relative to the one rod upper shaft any subsequent breakage should usually occur at the upper shaft portion which can be easily repaired as above described. This method of construction further provides a cost-effective method of repairing broken polo mallets so as to increase the durability and useful life thereof.

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A mallet comprising:

a striking head;

a central bore presenting an interior surface extending through said head, said central bore formed by first and second overlapping bores extending through said head;

a shaft presenting an upper handle end and a lower end, said lower end comprising:

first and second rods joined along a contiguous surface, said joined rods presenting an exterior surface having a configuration generally contiguous to said interior surface of said central bore upon insertion of said rods in said central bore, said joined rods configuration precluding rotation of said lower end of said shaft secured within said central bore;

means for securing said lower end of said shaft within said central bore.

2. The mallet as claimed in claim 1 wherein said upper handle end comprises:

a first end for grasping by a user;

a second opposed end;

means on said second opposed end and said shaft lower end for joining said second end of said upper handle end to said lower end of said shaft.

3. The mallet as claimed in claim 2 wherein said joining means comprises:

a first splice at said second end of said upper handle end;

a second complementary splice on said lower end of said shaft;

means for fixing said first splice to said second splice to join said handle end to said shaft lower end.

4. The mallet as claimed in claim 1 wherein said lower end further comprises:

a planar surface along each rod presenting said contiguous surface;

means along said planar surfaces whereby to join said rods.

5. The mallet as claimed in claim 4 wherein said joined planar surface traverses said central bore upon said insertion of said rods in said central bore.

6. A mallet comprising:

a striking head;

a central bore presenting an interior surface extending through said head, said central bore formed by first and second bores extending through said head;

a shaft presenting a handle;

first and second rods joined along a contiguous surface along each rod, said joined rods presenting an exterior surface generally congruent to a configuration of said interior of said central bore whereupon said exterior surface is generally contiguous to said interior surface upon insertion of said rods in said central bore;

means for securing said joined rods within said central bore; and means for joining said shaft to said joined rods.

7. The mallet as claimed in claim 6 wherein said joining means comprises:

a first splice at an end of said shaft;

a second complementary splice at an end of said joined rods;

means for fixing said first splice to said second splice to join said shaft to said rods.

8. The mallet as claimed in claim 6 further comprising:

a planar surface along an exterior surface of each rod presenting said contiguous surface;

means for fixing said planar surfaces one to another whereby to join said rods.

9. The mallet as claimed in claim 8 wherein said planar surface traverses said bore upon said insertion of said rods in said central bore.

10. A mallet comprising:

a striking head;

a central bore extending through said head, said central bore presenting an interior surface formed by first and second overlapping bores extending through said head;

a relatively flexible shaft presenting a handle to a user;

a relatively rigid shaft connected to said flexible shaft and formed by first and second rods joined along a contiguous surface, said rigid shaft presenting an exterior surface generally congruent to said interior surface of said central bore for a contiguous fit of said rigid shaft within said central bore;

means for securing said rigid shaft within said central bore.

11. The mallet as claimed in claim 10 wherein said flexible shaft comprises:

a rod presenting an upper end for grasping by a user;

a second end;

means for joining said second end of said flexible shaft to said rigid shaft.

12. The mallet as claimed in claim 11 wherein said shaft joining means comprises:

a first splice at an end of said rigid shaft;

a second complementary splice at an end of said flexible shaft;

means for attaching said first splice to said second splice to join said respective shafts.

13. The mallet as claimed in claim 10 wherein said first and second rods of said rigid shaft further comprise:

a planar surface along an exterior surface of each rod presenting said contiguous surface;

means for joining said planar surfaces of each rod one to another.

14. The mallet as claimed in claim 13 wherein said joined planar surfaces traverse said central bore upon said insertion of said flexible shaft in said central bore.

15. The mallet as claimed in claim 13 further comprising means for joining said rigid shaft to said flexible shaft, said means comprising:

a first splice at an end of said rigid shaft;

a second complementary splice at an end of said flexible shaft;

means for attaching said first splice to said second splice to join said respective shafts.

* * * * *